US010393331B2

(12) United States Patent
Hartman

(10) Patent No.: US 10,393,331 B2
(45) Date of Patent: Aug. 27, 2019

(54) LAMP AND ILLUMINATED HARDSCAPE

(71) Applicant: Hartman Design, Inc., Wernersville, PA (US)

(72) Inventor: Michael S. Hartman, Sinking Spring, PA (US)

(73) Assignee: Hartman Design, Inc., Wernersville, PA (US)

( * ) Notice: Subject to any disclaimer, the term of this patent is extended or adjusted under 35 U.S.C. 154(b) by 0 days.

(21) Appl. No.: 15/452,081

(22) Filed: Mar. 7, 2017

(65) Prior Publication Data

US 2017/0370540 A1 Dec. 28, 2017

Related U.S. Application Data

(63) Continuation of application No. 14/083,620, filed on Nov. 19, 2013, now Pat. No. 9,618,170, which is a continuation of application No. 13/279,820, filed on Oct. 24, 2011, now Pat. No. 8,672,502, which is a continuation of application No. 12/416,644, filed on Apr. 1, 2009, now Pat. No. 8,066,398, which is a (Continued)

(51) Int. Cl.

| | |
|---|---|
| ***F21S 8/00*** | (2006.01) |
| ***F21V 15/01*** | (2006.01) |
| ***F21V 21/02*** | (2006.01) |
| ***F21V 33/00*** | (2006.01) |
| *F21W 111/027* | (2006.01) |
| *F21W 131/103* | (2006.01) |
| *F21W 131/109* | (2006.01) |
| *E04F 11/104* | (2006.01) |
| *F21S 2/00* | (2016.01) |
| *F21W 131/10* | (2006.01) |

(52) U.S. Cl.

CPC ..... *F21S 8/036* (2013.01); *F21V 15/01* (2013.01); *F21V 21/02* (2013.01); *F21V 33/006* (2013.01); *E04F 2011/1048* (2013.01); *E04F 2290/026* (2013.01); *F21S 2/00* (2013.01); *F21S 8/033* (2013.01); *F21W 2111/027* (2013.01); *F21W 2131/10* (2013.01); *F21W 2131/103* (2013.01); *F21W 2131/109* (2013.01)

(58) Field of Classification Search

CPC ..... E04F 2011/1048; E04F 2290/026; F21S 2/00; F21S 8/033; F21S 8/036; F21V 15/01; F21V 21/02; F21V 33/006; F21W 2131/10; F21W 2131/103; F21W 2131/109

See application file for complete search history.

(56) References Cited

U.S. PATENT DOCUMENTS

| | | | |
|---|---|---|---|
| 4,888,669 | A | 12/1989 | Hanson |
| 5,570,000 | A | 10/1996 | Kowalski |
| 5,749,643 | A | 5/1998 | Porter et al. |

(Continued)

*Primary Examiner* — Ali Alavi

(74) *Attorney, Agent, or Firm* — Fox Rothschild LLP

(57) ABSTRACT

A lamp and a hardscape structure illuminated by the lamp are disclosed. The lamp is formed from a plate to which a light fixture is attached. The plate may have a flange, a decorative face plate and side panels attached to direct light from the fixture along the hardscape on which the lamp is mounted. Mounting is effected by positioning the plate between discrete hardscape elements that are stacked one atop another. A portion of the plate projects out from the structure allowing the fixture to cast light on the structure surface. A light transmitting cover is also provided.

17 Claims, 7 Drawing Sheets

Related U.S. Application Data continuation-in-part of application No. 11/517,130, filed on Sep. 7, 2006, now Pat. No. 7,524,077.

(56) References Cited

U.S. PATENT DOCUMENTS

| | | | | |
|---|---|---|---|---|
| 6,779,907 | B2 | 8/2004 | Beadle | |
| 7,290,904 | B2 | 11/2007 | Miller | |
| 7,524,077 | B2 * | 4/2009 | Hartman | F21V 15/01 362/145 |
| 8,002,447 | B2 | 8/2011 | Patti | |
| 8,066,398 | B2 * | 11/2011 | Hartman | F21V 15/01 362/145 |
| 8,419,205 | B1 * | 4/2013 | Schmuckle | F21V 33/006 362/145 |
| 8,672,502 | B2 * | 3/2014 | Hartman | F21V 15/01 362/145 |
| 9,175,840 | B2 * | 11/2015 | Patti | F21V 27/02 |
| 9,618,170 | B2 * | 4/2017 | Hartman | F21V 15/01 |
| 2009/0296410 | A1 | 12/2009 | Patti | |

* cited by examiner

FIG. 7
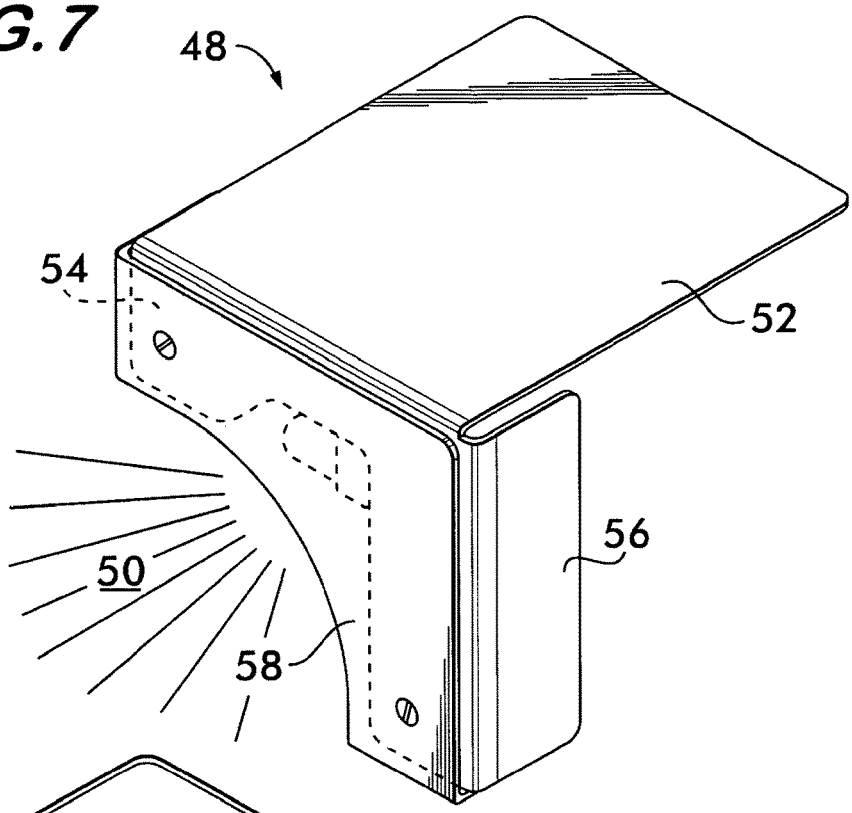
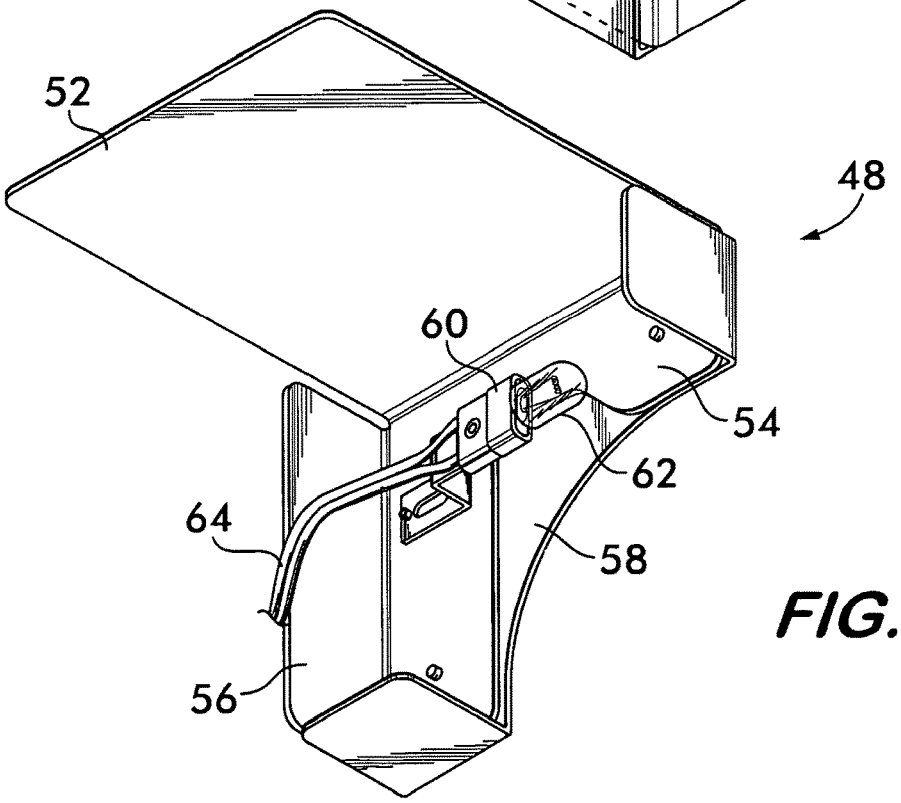
FIG. 8

LAMP AND ILLUMINATED HARDSCAPE

CROSS REFERENCE TO RELATED APPLICATION

This application is a continuation of U.S. application Ser. No. 13/279,820, filed Oct. 24, 2011, which is a continuation of U.S. application Ser. No. 12/416,644, filed Apr. 1, 2009, now U.S. Pat. No. 8,066,398, which is a continuation-in-part of U.S. application Ser. No. 11/517,130, filed Sep. 7, 2006, now U.S. Pat. No. 7,524,077, issued Apr. 28, 2009, and, which applications and patents are hereby incorporated herein by reference.

FIELD OF THE INVENTION

This invention relates to lighting for illuminating hardscape structures such as retaining walls.

BACKGROUND OF THE INVENTION

Masonry structures used as a part of a landscape design are known as the "hardscape". The hardscape incorporates structures such as pathways, steps, driveways, retaining walls and the like into an aesthetic installation generally, although not exclusively, in an outdoor setting which combines plant, masonry, and lighting elements to enhance the visual environment of a residence, commercial facility or school campus to cite but a few examples.

The hardscape may be formed of natural stone, bricks or blocks manufactured from concrete which are available in various colors, shapes and textures that simulate natural or quarried stone. Such products, for example, those provided by companies such as EP Henry of Woodbury, N.J., constitute structural systems which allow for the construction of structures such as retaining walls using discrete masonry elements that may be positioned atop one another to form a wall without the use of mortar. The structure is, nevertheless, a substantially permanent structure due to the weight, regular shape, friction and quasi-interlocking nature of the discrete elements.

As lighting is often an important component of the landscape design, it is desirable to incorporate lighting elements, such as lamps, into the design. Present practice features stand alone lamps that mount in the ground adjacent to the hardscaping. It would be advantageous to provide lamps that form an integral part of the hardscape.

SUMMARY OF THE INVENTION

The invention concerns a lamp adapted for mounting on a structure formed of a plurality of discrete elements stacked one atop another. The lamp comprises a plate positionable between at least two of the elements. Contact between the plate and the elements retains the lamp in position on the structure. A light fixture is attached to the plate.

Another embodiment of the invention concerns a lamp mountable on a wall formed of elements stacked one atop another. The lamp comprises a plate positionable between two of the elements. A flange is mounted on the plate. The flange is oriented at an angle to the plate and has a first surface facing outwardly away from the plate and a second surface positioned opposite thereto. A light fixture is attached to the second surface of the flange, and a face plate is attached to the first surface of the flange.

The lamp may further comprise first and second side panels located at opposite ends of the face plate. The side panels are oriented angularly with respect to the face plate.

The invention further encompasses an illuminated hardscape that comprises a wall formed of a plurality of discrete elements positioned one atop another. A lamp is mounted on the wall. The lamp comprises a plate positioned between at least two of the elements. Contact between the plate and the elements retains the lamp in position on the wall. A light fixture is attached to the plate. A portion of the plate projects outwardly from the wall. The light fixture is attached to the projecting portion of the plate.

In another embodiment, the invention includes an illuminated hardscape. The hardscape comprises at least one tread of a step formed of a plurality of discrete elements positioned one atop another. A lamp is mounted on a riser above the tread. The lamp comprises a plate positioned between at least two of the elements. Contact between the plate and the elements retains the lamp in position on the riser. light fixture is attached to the plate.

Preferably, the lamp is positioned on one side of the step and comprises an elongated side panel positioned on one side of the lamp. The elongated side panel directs light from the lamp to an opposite side thereof. The lamp may also have a face plate positioned adjacent to the elongated side panel. The face plate has an asymmetrical shape for further directing light from the lamp to the opposite side.

The invention also includes a method of constructing an illuminated hardscape. The method comprises: assembling the hardscape by positioning a plurality of discrete elements one atop another; providing a lamp comprising a plate and a light fixture attached to the plate; and positioning the plate between at least two of the elements, contact between the plate and the elements retaining the lamp in position on the hardscape.

The invention further provides a light transmitting cover for the lamp. The cover acts to protect the lamp from the environment and can provide other benefits such as light enhancement, e.g., colored lenses, light diffusion, etc.

BRIEF DESCRIPTION OF THE DRAWINGS

The following detailed description will be better understood when read in conjunction with the figures appended hereto. For the purpose of illustrating the invention, there is shown in the drawings preferred embodiments. It is understood, however, that this invention is not limited to this embodiment or the precise arrangements shown.

FIG. 7 is a front perspective view of another embodiment of a lamp according to the invention;

FIG. 8 is a rear perspective view of the lamp embodiment shown in FIG. 7;

DETAILED DESCRIPTION OF THE EMBODIMENTS

Figure 1:
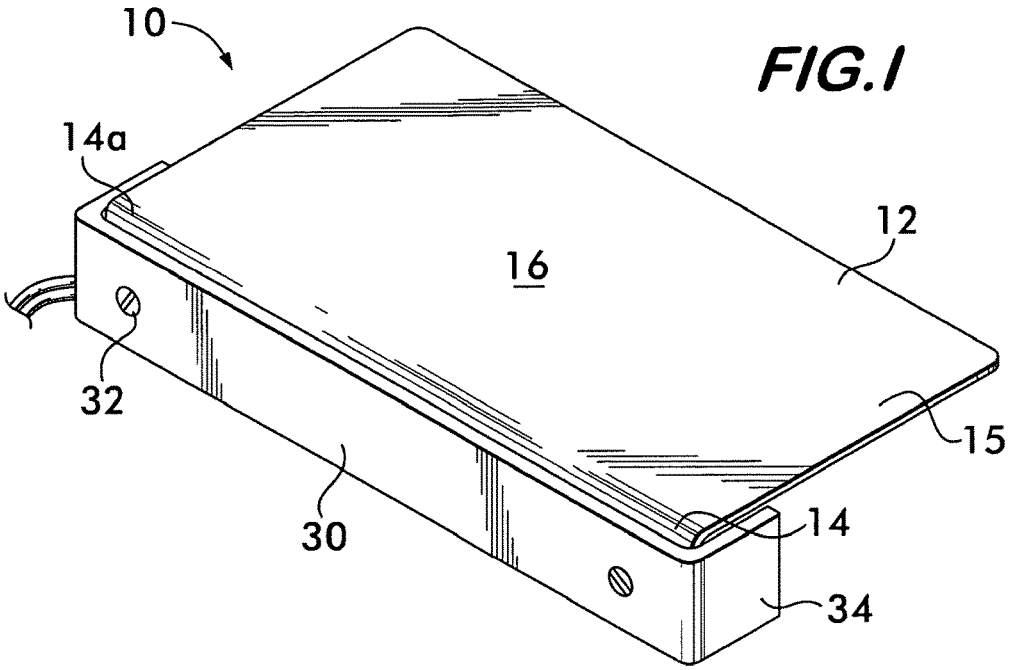
FIG. 1 is a perspective view of a lamp according to the invention.
Figure 2:
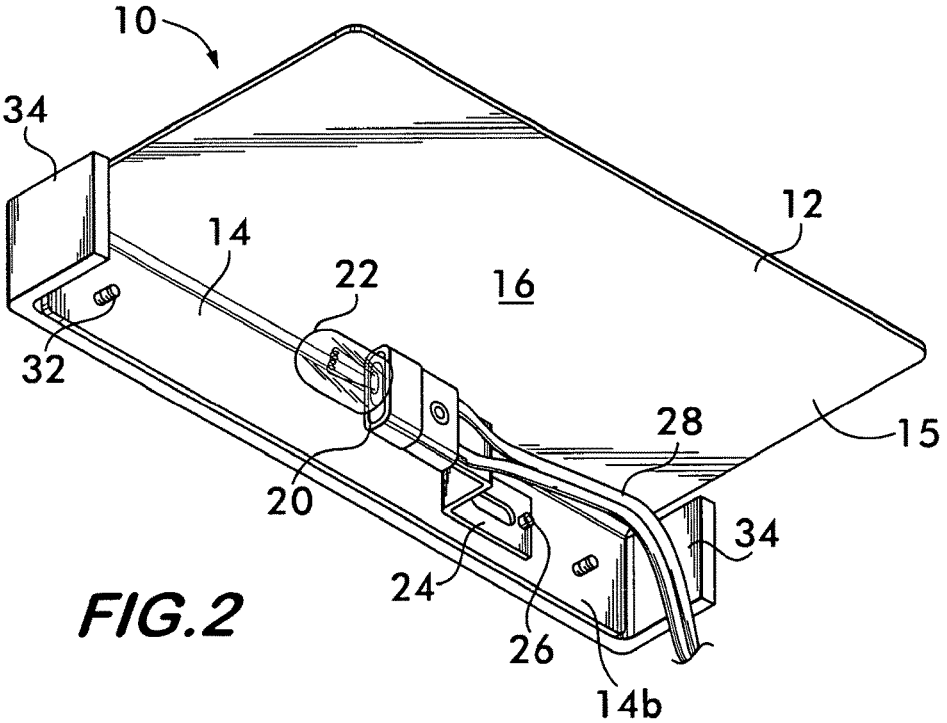
FIG. 2 is a rear perspective view of the lamp shown in FIG. 1.
Figure 3:
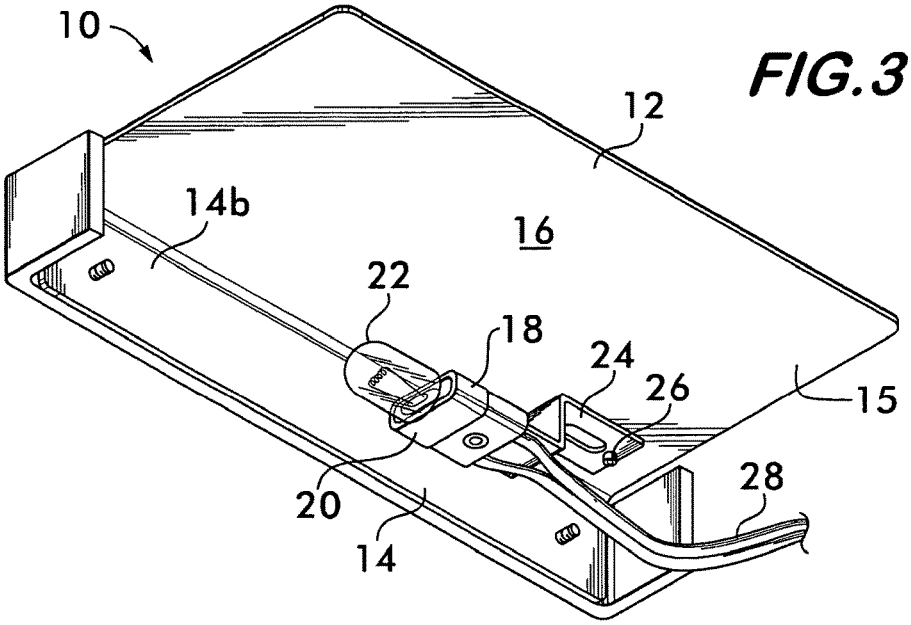
FIG. 3 is a rear perspective view of another embodiment of a lamp according to the invention.

FIGS. 1 and 2 show a lamp 10 integrable into a hardscape structure for illumination. Lamp 10 comprises a plate 12 having a flange 14 attached thereto. Plate 12 has a top side 13 and an underside 15. Flange 14 may be integral with the plate and oriented transversely to the plane 16 of the plate. A right angle flange is shown, but it is understood that the flange could be oriented at virtually any angle relative to the plate. A light fixture 18 is attached to the plate 12. In the embodiment shown in FIG. 2, the light fixture is attached to plate 12 by way of flange 14, although it could also be attached directly to the plate as shown in FIG. 3. Light fixture 18 provides a socket 20 that receives a bulb 22. The fixture may be mounted using a bracket 24 that is attached using a fastener 26, such as a rivet. Bracket 24 may also be attached in other ways, such as with adhesives, by welding as well as brazing. An electrical power line 28 extends from the fixture, the power line being connectable to a source of electrical power, such as a transformer, as described below. The bulb 22 can be of any suitable type, including LED type light sources.

As best illustrated in FIG. 1, a decorative face plate 30 may be attached overlying a surface 14*a* of the flange 14, the surface 14*a* facing away from plate 12. The light fixture 18, when attached to the flange, is attached to the opposite surface 14*b* shown in FIG. 2. Attachment of the face plate to the flange is via fasteners 32, such as screws. Adhesives, brazing and welding are also feasible attachment methods. Side panels 34 may be mounted at opposite ends of the face plate 30. Together the face plate, flange and the side panels help direct illumination from the bulb 22 in a direction downwardly along the hardscape on which the lamp is mounted.

Figure 4:
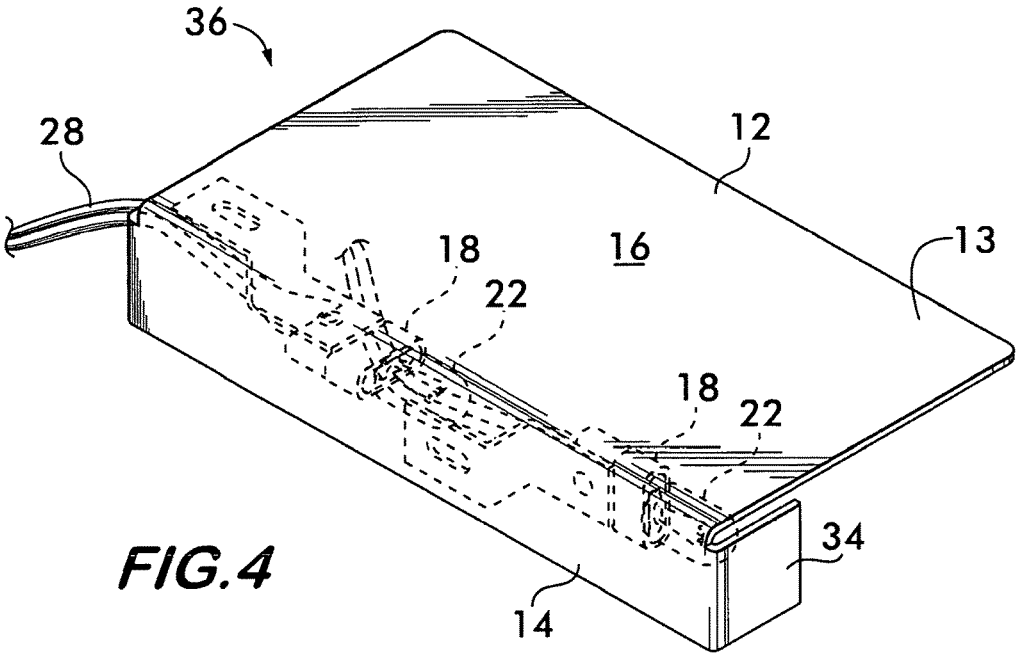
FIG. 4 is a perspective view of another embodiment of a lamp according to the invention.

FIG. 4 illustrates another embodiment 36 of the lamp according to the invention. Lamp 36 comprises a plate 12 to which a light fixture 18 may be attached, either directly or via a flange 14 as shown. In this embodiment, side panels 34 are positioned at opposite ends of flange 14. The flange and the side panels cooperate to direct light from the bulb 22 in fixture 18 downwardly along the hardscape on which the lamp is mounted. The flange may be integrally formed with the plate and bent or molded into the angular orientation desired. Likewise, the side panels may be an integral part of the flange bent or molded into an angular orientation.

It is advantageous to make the plate, flange, face plate and side panels from robust materials such as metal that can withstand the effects of weather. The plate and flange may be, for example, aluminum or stainless steel to prevent corrosion, and the faceplate and side panels may be copper or brass for a decorative effect. Plastics and fiber reinforced composites may also be used, as well as a combination of metals, plastics and other materials.

Figure 5:
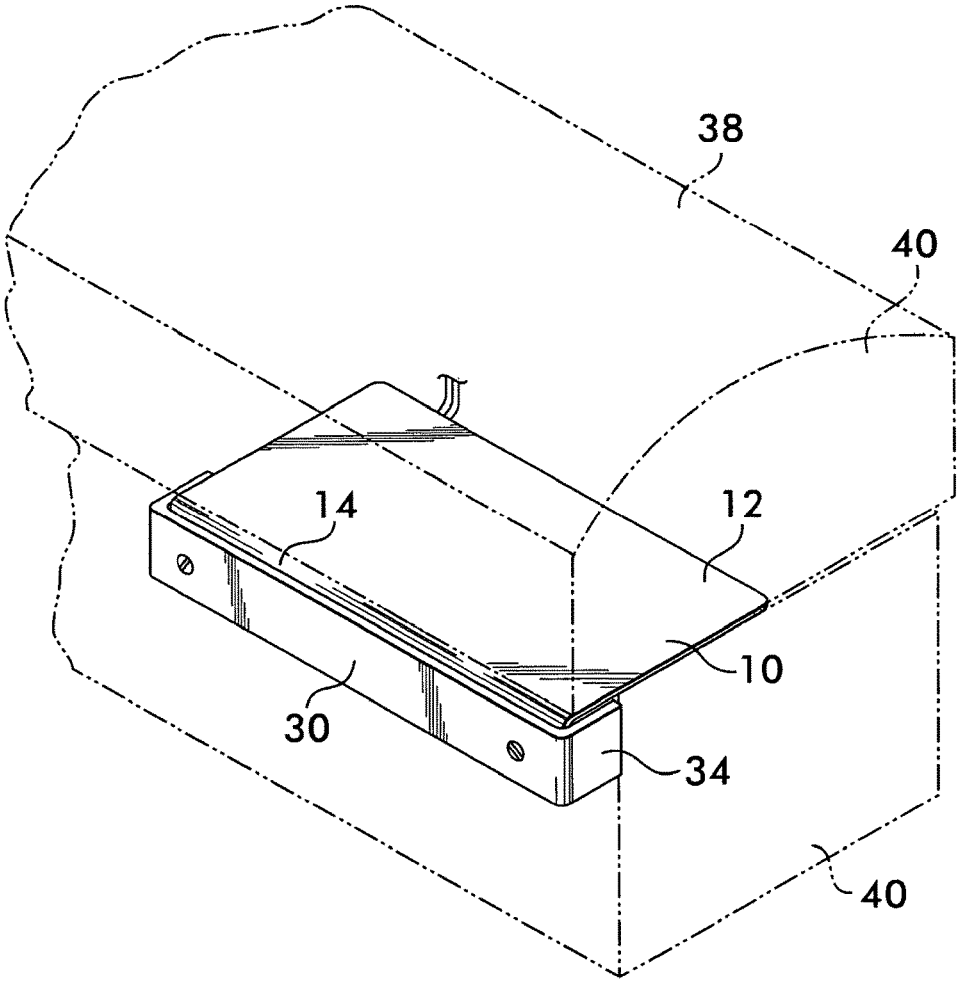
FIG. 5 is a detailed perspective view of a portion of a hardscape structure having a lamp according to the invention.

As shown in FIG. 5, the lamp 10 is integrated into a hardscape structure, such as a retaining wall 38, a portion of which is shown in phantom line. Retaining wall 38 is formed from discrete block-like elements 40 positioned atop one another, and the plate 12 of lamp 10 is positionable between the block-like elements 40 for mounting on the wall. The plate is thin enough and the blocks sufficiently coarse that the presence of the plate does not significantly affect the stacking of the blocks. The lamp takes the orientation of the strata in which it is positioned. The lamp is retained to the wall by contact between the plate 12 and the block-like elements 40 and does not require separate fasteners. The lamp is positioned with a portion of the plate 12 projecting from the wall so that the flange 14 is in spaced relation away from the wall. This provides a space between the flange and the wall for the light fixture and the bulb to illuminate the surrounding area.

Figure 6:
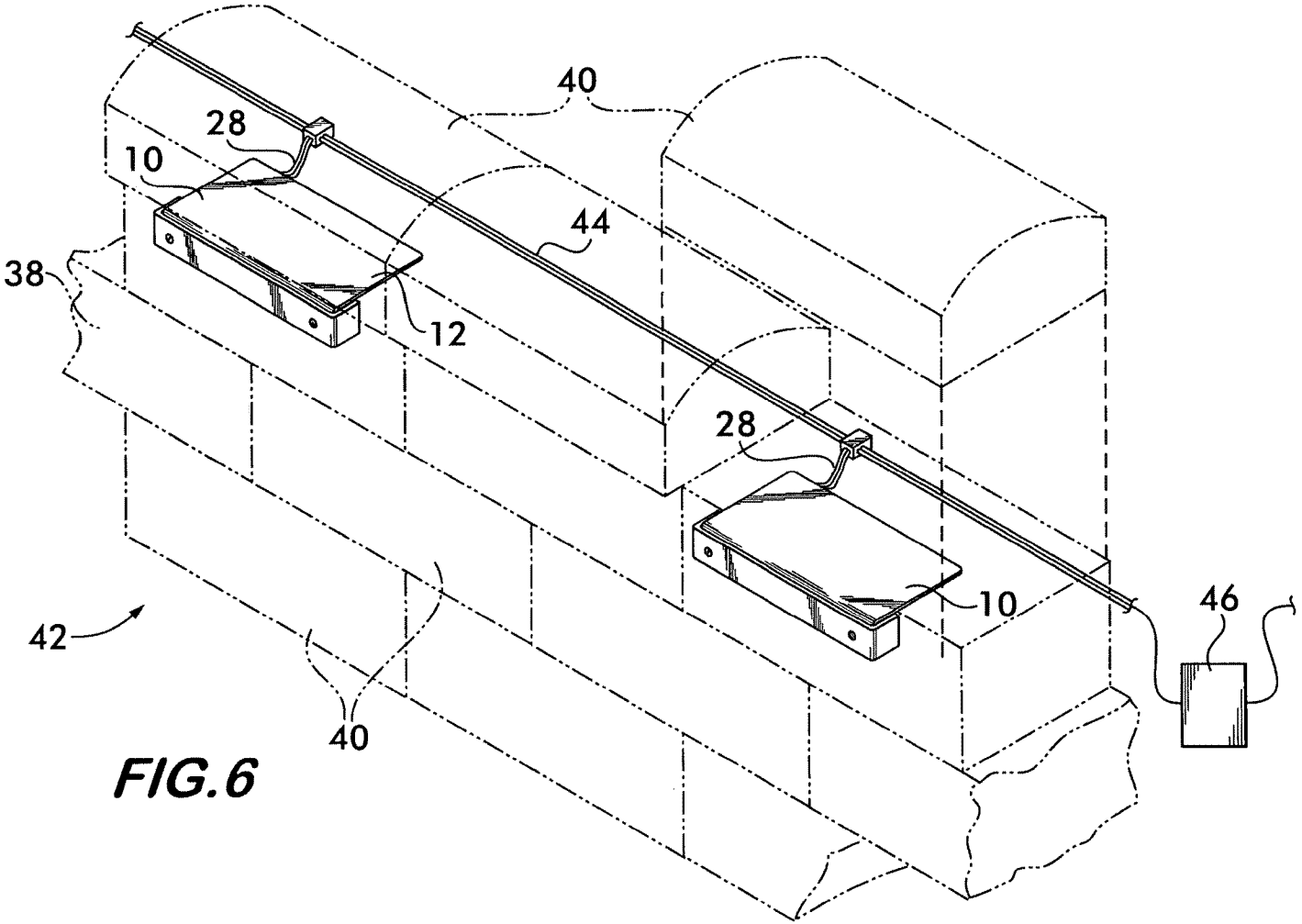
FIG. 6 is a perspective view of an illuminated hardscape under construction.

FIG. 6 shows an illuminated hardscape 42 being constructed, in this example, the aforementioned retaining wall 38. A plurality of lamps 10 are integrally mounted within the retaining wall by positioning the plates 12 between discrete block-like elements 40 as they are stacked atop one another to form the hardscape. No special tools are required, and the components of the lamp are readily accessible for repair or replacement, providing significant ease of maintenance. Power lines 28 extend from the lamps and are connected via a bus 44 to a power source, such as a transformer 46, which steps 110 volt household electrical service to a low voltage typically used with outdoor lighting systems. Although plates 12 are shown oriented horizontally in the wall 38, it is understood that a vertical orientation is also feasible by positioning the plate within the vertical seam between two adjacent block-like elements 40.

FIG. 7 shows another embodiment of a lamp 48 according to the invention. Lamp 48 is configured asymmetrically so that it casts its light 50 predominantly to one side. Lamp 48 is constructed similarly to the embodiments previously described in that it comprises a plate 52 and a flange 54. The flange is asymmetrically arranged with an elongated side panel 56 on one side which helps to direct the light in a preferred direction. The lamp may also include a face plate 58 to hide the structural components of the lamp and further direct the light as desired. Note that the elongated side panel may be integrally formed with the flange, attached to the flange, integrally formed with the face plate, or attached to the face plate. As shown in FIG. 8, a light fixture 60 is attached to lamp 48, preferably to flange 54. The light fixture receives a bulb 62 and has a power cord 64.

Figure 9:
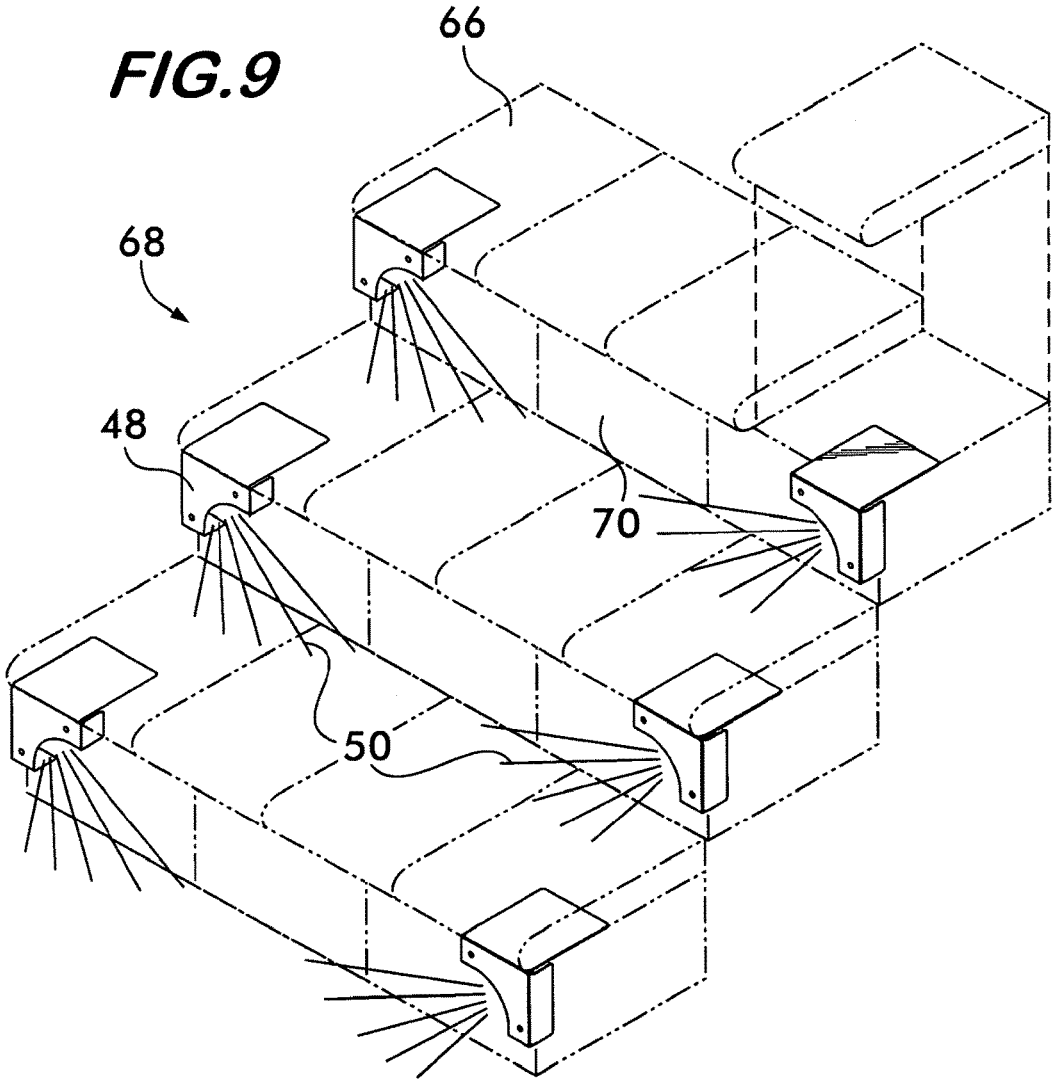
FIG. 9 is a perspective view of an illuminated hardscape comprising steps under construction.

Asymmetrical lamps 48 are advantageous for illuminating treads 66 of steps 68 as shown in FIG. 9. Two lamps may be positioned in spaced relation along a riser 70 and oriented so that their light 50 converges on the tread 66. This configuration will provide more even illumination of steps and better define the limits and extent of the steps for both safety and aesthetic advantage.

Figure 10:
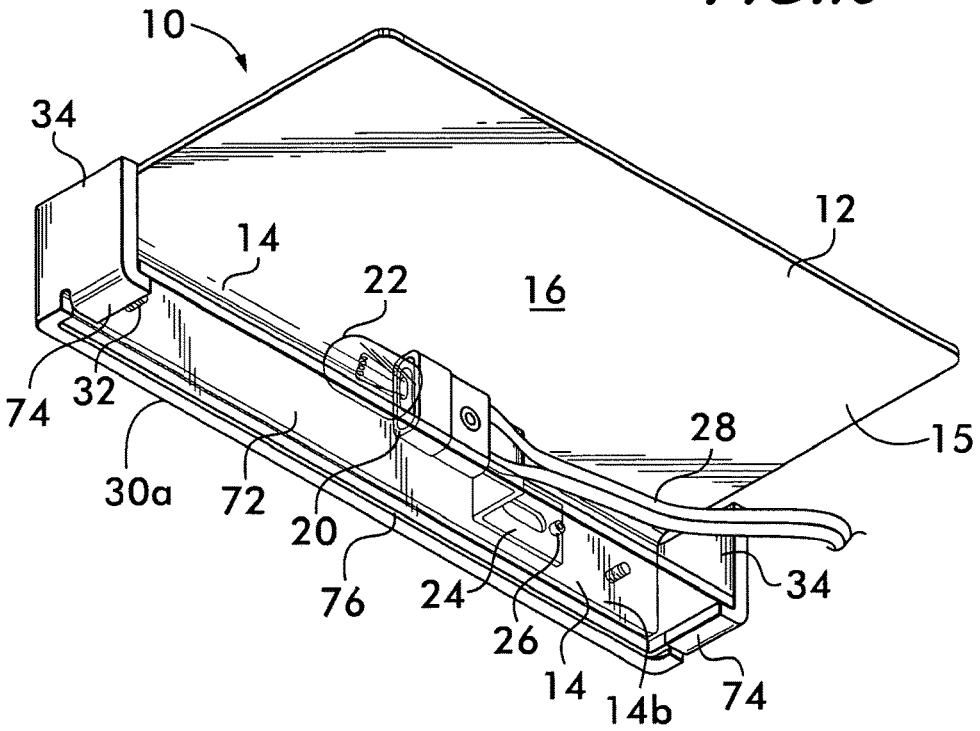
FIG. 10 is an alternative embodiment of a face plate having a light cover.

With reference to FIG. 10, an embodiment providing a light transmitting cover attached to the lamp 10 to cover light fixture 18 (including the socket 20 and bulb 22) is now described. In this preferred embodiment, a decorative face plate 30*a*, similar to the faceplate 30 shown in FIGS. 1 and 2, is attachable to the plate 16 overlying the surface 14*a* of the flange 14 in a similar manner as that of faceplate 30, which in this case would be attached with screws 32. A rectangular light transmitting cover 72 extends along a bottom of the face plate 30*a* between side panels 34 supported on support tabs 74 which extend from the side panels 34 as illustrated. The light transmitting cover can be made of any suitable material, such as polycarbonate or borosilicate glass, and preferably attached to the face plate with a suitable adhesive 76 such as a silicone RTV (room temperature vulcanizing) sealant. As used herein, "light transmitting" includes any suitable light translucent and light transparent materials, as well as lenses or other materials that allow light to pass through.

The light cover 72 prevents water from splashing onto the bulb and socket. When the light is on, the bulb and socket can get very hot and become prone to cracking if splashed with much cooler water, e.g., rain that splashes off of the pavement and up into the light fixture. The light cover also offers other benefits, such as the ability to enhance the light through the use of filters, colored glass to color the light, lenses to diffuse or focus the light, and to provide other desirable effects. It is also appreciated that other embodiments are possible. For example, the light cover could be in the form of a smaller cover or of different shapes and can be mounted to the lamp in different ways. Other possible alternative embodiments contemplated include a cover that clips onto the bulb or socket, or which is attached directly to the plate 12 and not through the decorative face plate 30*a*. It is also appreciated that by adding the light cover to the face plate 30*a* or other attachable means which can be added easily to the lamp, various alternative options for different light enhancements can be provided to the consumer.

Lamps according to the invention provide a simple and elegant illumination for hardscape design that is easy to install and maintain. Such lamps are readily removable and repositionable and facilitate repair or reconfiguration of the hardscape as required. They may be used with any form of hardscape, for example, concrete products such as blocks or bricks, natural stone, mortared or stacked structures, wooden structures such as decks and retaining walls made from railroad ties to cite but a few exemplary applications.

What is claimed is:

1. A lamp configured for mounting on a structure formed of a plurality of discrete elements stacked one atop another, said lamp comprising:

a plate configured to be received between at least two of the discrete elements so that contact between the plate and the two discrete elements retains the lamp in position on the structure; the plate having a substantially planar top side and a substantially planar underside; the plate having a length and a width each substantially larger than a thickness of the plate between the top side and the underside;

a lighting element mounted on the underside of the plate and comprising a light source configured to direct light in at least a first direction perpendicular to the underside; and a flange extending in the first direction and configured to block the light from the light source in a second direction, the second direction being substantially perpendicular to the first direction and extending away from the two discrete elements when the lamp is mounted on the structure, wherein the plate and the flange are integrally formed from a single piece of metal.

2. The lamp of claim 1, wherein the plate comprises a first portion configured to be received between the two discrete elements, and a second portion; and the lighting element is mounted on the second portion.

3. The lamp of claim 1, further comprising side panels positioned at opposite ends of the flange and configured to block the light from the light source in at least a third direction substantially perpendicular to the first and second directions.

4. A lamp configured for mounting on a structure formed of a plurality of discrete elements stacked one atop another, said lamp comprising:

a first member configured to be received between at least two of the discrete elements so that contact between the first member and the two discrete elements retains the lamp in position on the structure; the first member having a substantially planar top side and a substantially planar underside; the first member having a length and a width each substantially larger than a thickness of the first member between the top side and the underside;

a lighting element comprising a light source configured to direct light in a first direction away from the underside of the first member; and a second member having an outwardly-facing surface located in a plane substantially coincident with a forward edge of the first member, and an inwardly-facing surface oriented toward the light source; wherein first member and the second member are integrally formed, and the lighting element is mounted on at least one of the underside of the first member and the inwardly-facing surface of the second member.

5. The lamp of claim 4, wherein the lighting element is suspended from the underside of the first member.

6. The lamp of claim 4, wherein the first member comprises a first portion configured to be received between the two discrete elements, and a second portion; and the lighting element is mounted on the second portion.

7. The lamp of claim 4, wherein the first member comprises a plate.

8. The lamp of claim 7, wherein the second member comprises a flange.

9. The lamp of claim 8, further comprising side panels positioned at opposite ends of the flange and each having an inwardly-facing surface oriented toward the light source.

10. The lamp of claim 9, wherein: the flange is configured to block the light from the light source in a second direction, the second direction being substantially perpendicular to the first direction and extending away from the two discrete elements when the lamp is mounted on the structure; and the side panels are configured to the block the light from the light source in at least a third direction substantially perpendicular to the first and second directions.

11. The lamp of claim 4, wherein the lighting element is spaced apart from the second member.

12. A lamp configured for mounting on a structure formed of a plurality of discrete elements stacked one atop another, said lamp comprising:

a first member having a first portion configured to be received between at least two of the discrete elements so that contact between the first portion and the two discrete elements retains the first member in position on the structure in a substantially horizontal orientation, and a second portion adjoining the first portion; the first member having a substantially planar top side and a substantially planar underside; the first member having a length and a width each substantially larger than a thickness of the first member between the top side and the underside;

a lighting element mounted underneath the second portion of the first member and comprising a light source configured to direct light downwardly; and a second member located below the second portion of the first member, wherein the first member and the second member are integrally formed, and the light source is configured to be positioned between the second member and at least one of the two discrete elements when the first member is received between the least two of the two discrete elements.

13. The lamp of claim 12, wherein the first member comprises a plate.

14. The lamp of claim 13, wherein the second member comprises a flange.

15. The lamp of claim 14, further comprising side panels positioned at opposite ends of the flange and each having an inwardly-facing surface oriented toward the light source.

16. The lamp of claim 15, wherein the flange is configured to block the light from the light source in a second direction, the second direction being substantially perpendicular to the first direction and extending away from the two discrete elements when the lamp is mounted on the structure, and the side panels are configured to block the light from the light source in at least a third direction substantially perpendicular to the first and second directions.

17. A lamp adapted for mounting on a structure formed of a plurality of discrete elements stacked one atop another, said lamp comprising:

a plate positionable between at least two of said elements, contact between said plate and said elements retaining said lamp in position on said structure, said plate having a top side and an underside;

a flange, wherein: said flange is oriented substantially at a right angle to the plane of said plate; said flange has a first surface facing away from said plate and a second surface positioned opposite said first surface; and said flange and said plate are integrally formed from a single piece of metal; and a light fixture attached to said lamp, said light fixture being positioned facing said underside of said plate and said second surface of said flange.

* * * * *